US007399452B2

(12) United States Patent
Radel et al.

(10) Patent No.: US 7,399,452 B2
(45) Date of Patent: Jul. 15, 2008

(54) MEANDER-TYPE CATALYTIC CONVERTER

(75) Inventors: Harry Radel, Geesthact (DE); Markus Krueger, Bad Segeberg (DE)

(73) Assignee: Dolmar, GmbH, Hamburg (DE)

( * ) Notice: Subject to any disclaimer, the term of this patent is extended or adjusted under 35 U.S.C. 154(b) by 481 days.

(21) Appl. No.: 11/155,188

(22) Filed: Jun. 16, 2005

(65) Prior Publication Data

US 2006/0039836 A1 Feb. 23, 2006

(30) Foreign Application Priority Data

Jun. 17, 2004 (DE) ..... 20 2004 009 506 U
Dec. 20, 2004 (DE) ..... 20 2004 019 896 U

(51) Int. Cl.
*B01D 50/00* (2006.01)
*F01N 3/00* (2006.01)
*F01N 3/10* (2006.01)
*B01J 8/02* (2006.01)

(52) U.S. Cl. ..... 422/177; 422/171; 422/174; 422/221; 422/222; 60/282; 60/295; 60/296; 60/299; 60/300; 60/301; 60/302

(58) Field of Classification Search ..... 422/176, 422/177, 180, 179, 171, 174, 221, 199, 222, 422/55, DIG. 10, DIG. 30, 481, 521; 60/282, 60/295, 296, 299, 301, 302, 300
See application file for complete search history.

(56) References Cited

U.S. PATENT DOCUMENTS 4,363,753 A * 12/1982 Bozon et al. ..... 502/439
4,869,738 A * 9/1989 Alcorn et al. ..... 422/177
6,534,021 B1 * 3/2003 Maus ..... 422/180
7,055,314 B2 * 6/2006 Treiber ..... 60/297
7,128,772 B2 * 10/2006 Bruck ..... 55/385.3
2001/0043891 A1 * 11/2001 Adiletta ..... 422/177
2002/0141910 A1 * 10/2002 Adiletta ..... 422/171

(Continued)

FOREIGN PATENT DOCUMENTS

DE 3744265 A1 * 7/1989

(Continued)

OTHER PUBLICATIONS

Machine translation of Westmeier Siefried (DE 198 45 381 C1).*

*Primary Examiner*—Walter D. Griffin
*Assistant Examiner*—Huy-Tram Nguyen
(74) *Attorney, Agent, or Firm*—Kelly Lowry & Kelely, LLP

(57) ABSTRACT

To provide an exhaust system (100) for an internal combustion engine having a housing (10) in which there are provided at least one exhaust inlet port (15*b*) and another exhaust discharge port (15*a*), and a catalyst element (22), which is disposed within the housing (10) of the exhaust system (100) for purifying the exhaust of the internal combustion engine in such a manner that a substantial part of the exhaust at least is caused to flow through the catalyst element (22), that is readily manufacturable at a low cost and still allows for purification of the entire exhaust by the catalyst element without causing power loss to the internal combustion engine, it is suggested that the exhaust gases (27) alternately flow through the catalyst element (22) through an exhaust conducting means (17).

13 Claims, 6 Drawing Sheets

U.S. PATENT DOCUMENTS

Figure 1:
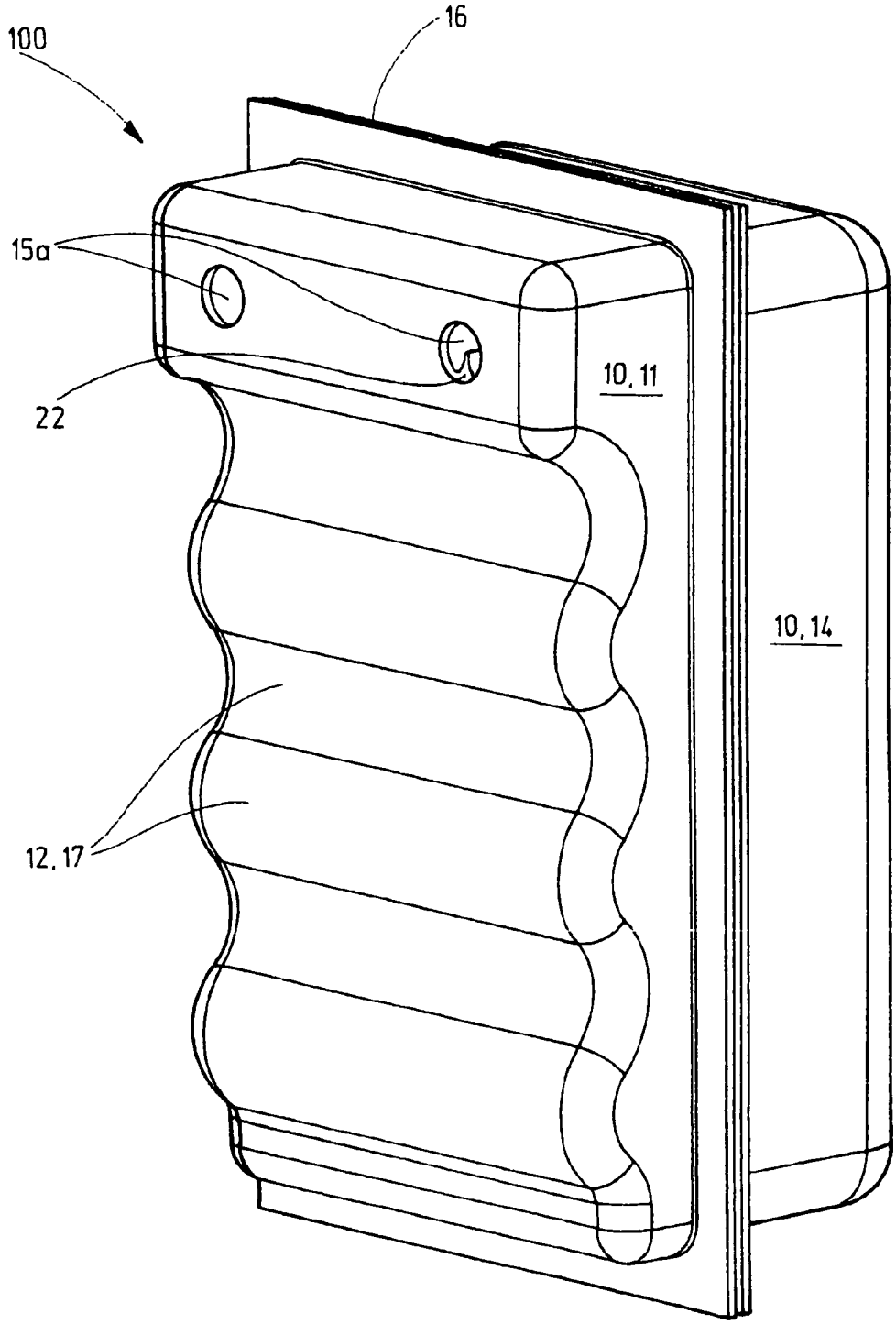

2004/0013580 A1* 1/2004 Bruck et al. ..... 422/171

FOREIGN PATENT DOCUMENTS

DE 197 04 147 A1 8/1998
DE 198 45 381 C1 12/1999
DE 199 32 778 A1 1/2001
DE 102 02 005 A1 8/2002

* cited by examiner

MEANDER-TYPE CATALYTIC CONVERTER

SPECIFICATION

The invention relates to an exhaust system for an internal combustion engine that may be both a two-stroke or a four-stroke Otto cycle engine. Thanks to its compact construction, this exhaust system may also be utilized in hand-operated machines such as gasoline-powered chain saws, hedge trimmers or the like. The exhaust system thereby comprises a housing provided with at least one exhaust inlet port and another exhaust discharge port. In order to prevent the exhaust gases of the internal combustion engine from being discharged un-purified into the atmosphere, a catalyst element is additionally disposed in the housing of the exhaust system so that at least a major part of the exhaust is caused to flow through the catalyst element before the entire exhaust is discharged into the atmosphere through the exhaust discharge port.

It has been known in prior art to utilize catalyst elements in the exhaust system to reduce the emissions of air contaminants from internal combustion engines. Said catalyst elements permit to subsequently treat the exhaust with the components contained therein. The exhaust's hydrocarbons are converted to carbon dioxide and carbon monoxide respectively using therefore the residual oxygen content. To ensure, as far as practicable, that the entire exhaust flows through the catalyst element for purification, complex and, as a result thereof, expensive catalyst elements are finding application. Usually, coated honeycomb catalysts are utilized for this purpose. These are positioned in the exhaust system by means of a complex mechanical construction.

One problem however lies in the high production expense and in the resulting high production cost of such type exhaust systems. Also, the construction for positioning the catalyst element results in a considerable flow resistance leading, inter alia, to a power loss of the internal combustion engine. Furthermore, the respectable increase in temperature the exhaust experiences while flowing through the catalytic converter affects the usable life of the latter so that additional technical measures have to be taken to reduce the exhaust temperature.

In view thereof, it was the object of the invention to provide an exhaust system having a catalyst element of the type mentioned herein above that is readily manufacturable at a low cost while still allowing for all the exhaust to be purified by the catalyst element without resulting in power loss of the internal combustion engine.

This object is solved by the features recited in claim 1, said features being of particular importance as will be explained herein after.

The exhaust system for an internal combustion engine of the invention comprises a housing in which there is provided at least one exhaust inlet port and another exhaust discharge port. In order to comply with the ever more stringent environmental guidelines, a catalyst element is disposed in the housing of the exhaust system, said catalyst element serving to purify at least the major part of the combustion exhaust before these exhaust gases are discharged into the atmosphere. In order however to ensure that all of the exhaust gases generated by the internal combustion engine are purified, there is provided an additional exhaust conducting means that alternately forces the exhaust gases to flow through-the catalyst element. The particular arrangement of the catalyst element in the exhaust conducting means can be directly compared to a connection in series of a plurality of catalyst elements or rather to a plurality of catalyst elements being connected one behind the other and through which the exhaust gases are conducted step by step. It is thus made certain that the exhaust or part of it is in any case prevented from being discharged into the atmosphere in an unpurified state. Since the exhaust gases are forced by the additional exhaust conducting means to alternately pass through the catalyst element, an almost complete chemical reaction (hydrocarbon conversion) is allowed to take place to purify the exhaust. In accordance with the invention, the expression "to alternately flow through" means that the exhaust stream flows through the catalyst element from alternate sides, i.e., for example alternately from the top and from the bottom or from the right and from the left side so that, from its entry into the housing to its exit therefrom, the exhaust stream is conducted several times through the catalyst element, more specifically through consecutive portions thereof. Also, the additional exhaust conducting means allows for a particular simple mechanical construction of the exhaust system as this will still be shown in the description given herein after.

There is more specifically provided that the catalyst element (22-25) be even, or rather largely even and planar, and that portions of the catalyst element are configured so that the exhaust is allowed to alternately flow consecutively through said portions so that the exhaust gases (27) are caused by an exhaust conducting means (17) to alternately flow several times through the catalyst element (22).

As a result, the catalyst element is optimally made use of along its entire length and can be combined with a simple exhaust conducting element.

For, in a variant of the exhaust system in accordance with dependent claim 9, at least one portion of the exhaust conducting means is preferably configured like a conduit-(such as a water or a gas conduit), with the shape of the cross-sectional area of the portion through which the exhaust gases are caused to flow being of no importance. Additionally, the catalyst element is fixed in this conduit-like portion by the very exhaust conducting means. Accordingly, no further measures are needed in terms of construction to hold the catalyst element stationary in the exhaust system.

Another object of the invention was to increase durability of the catalyst element by dissipating the additional heat generated therein. This further object is solved by the features recited in the claim.

In an exhaust system in accordance with the preamble of claim 11, an outer shell of the housing is used as a part of the conduit-type exhaust conducting means. Accordingly, a major portion of the heat generated in the catalyst element is dissipated through the outer shell of the housing. By thus cooling the exhaust gases, the durability of the catalyst element is increased. Moreover, the mechanical construction of the exhaust system can be further simplified.

Further advantageous implementations of the exhaust system are described in the subordinate claims 2 through 19.

In order to improve the purification effect of the exhaust system of the invention, the catalyst element can be disposed in the exhaust conducting means in such a manner that the exhaust is forced to alternately flow therethrough several times. Accordingly, the exhaust gases are forced to flow at least once on the left and on the right side through the catalyst element before they are discharged into the atmosphere. This permits to achieve an optimal effect with but one catalyst element. Accordingly, a simple flat catalyst element suffices to achieve the purification desired. If, by contrast, it suffices to achieve a lower conversion rate only, a partially coated catalyst element can also be utilized since the exhaust gases are conducted through the catalyst element several times anyway. Overall, a low cost exhaust system can thus be manufactured.

In an additional embodiment of the exhaust system, a catalyst element is utilized that is built to be self-supporting. This measure dispenses with the need for additional supporting or holding constructions for positioning the catalyst element within the housing since it is capable of being supported all by itself in the housing or in the exhaust conducting means.

Since the exhaust gases are forced through the catalyst element several times anywa; it suffices, in another embodiment of the exhaust system of the invention, to use a mesh-type catalyst element. As contrasted to a honeycomb catalyst element, a mesh-type catalyst element comprises a much lower flow resistance. For this purpose, metal wire meshes provided with a particular coating that are commercially available in the form of low cost wrought products can be utilized as the catalyst elements. Usually, said catalyst elements also are self-supporting so that the afore mentioned advantages apply here as well. Moreover, these catalyst elements can be readily adapted at low cost to the respective conditions of utilization, e.g. by deforming them into any shape.

As an alternative to a mesh-type catalyst element, a catalyst element in the form of a perforated plate may also be inserted into the exhaust system, this catalyst element also exhibiting the advantages mentioned herein above. Accordingly, the catalyst element can contain perforated metal plates provided with a particular coating. The shape of the holes in the perforated plates is optional.

In a particular exemplary embodiment, the catalyst element is disposed in the exhaust conducting means where it is held stationary by fastening means. Said fastening means may thereby be provided both inside and outside of the exhaust conducting means. As a self-supporting catalyst element can also be used, one or two fastening means provided on one or on both front sides of the catalyst element will suffice to secure them in the exhaust conducting means. It may for example be envisaged to clamp the catalyst element at one or at both sides between two parts of the housing, said parts serving as the fastening means. In this exemplary embodiment, it is readily possible to realize a bypass for the exhaust gases in the exhaust conducting means so that the conversion rate of the exhaust system can be readily adjusted. Moreover, this particular way of fastening the catalyst element allows for higher overall process tolerances of the exhaust system and its associated parts. Further, a heat-dependent change in the shape, e.g. as a result of expansion under the action of heat followed by cooling, may be excluded, thus preventing the assembled parts from "clattering".

In a variant of the exhaust system, the conduit-type exhaust conducting means as set forth in claim 9 is appropriately built from two parts. As a result, mounting the catalyst element within the exhaust conducting means is particularly simple and fast to perform. For this purpose, the catalyst element needs merely be placed onto the first portion of the exhaust conducting means to then cause it to compressively and frictionally interlock with the second portion in the exhaust conducting means.

In the already described, particularly advantageous implementation of the invention as set forth in claim 11, at least one outer shell of the housing forms a part of the exhaust conducting means. Likewise, it is envisaged that another part of the conduit-type exhaust conducting means may be configured to be a deflecting shell that is retained by the outer shells of the housing. The housing may thereby consist of at least two outer shells, namely a rear shell and a front shell. One of these two shells can be chosen to be used as a part of the exhaust conducting means, the deflecting shell, which is another part of the exhaust conducting means, being retained by assembly with the other outer shell. Accordingly, the exhaust systems of the invention can be readily produced at a low cost.

Another variant of the exhaust system is provided if the deflecting shell, that is, the second part of the exhaust conducting means, and an outer shell of the housing are made from one piece. Accordingly, it is envisaged that, overall, the housing and the exhaust conducting means may be built from two parts. A rear shell of the housing and a deflecting shell of the exhaust conducting means may for example be made from one piece. A front shell of the housing may concurrently serve as another part of the exhaust conducting means. It is understood that front and rear shell can be interchanged in this example. A particularly simple variant of the exhaust system is thus achieved, which is readily manufacturable at a low cost.

In order to assemble the outer shells of the housing, one of which is designed as a part of the exhaust conducting means, and the deflecting shell forming the other part of the exhaust conducting means, it is proposed to bead the rim of one of the two outer shells in such a manner that the very housing and the exhaust conducting means are solidly joined together. This measure dispenses with the need for a welded or soldered joint for assembling the various parts which brings further cost saving.

Appropriately, the conduct-type exhaust conducting means can be devised with meanders with undulated portions of the exhaust conducting means fixating an even or flat catalyst element within. A longitudinal section through such an exhaust conducting means resembles a meandering river. The undulated portions cause on the one side the catalyst element to be clamped within the exhaust conducting means and on the other side the surfaces of the two exhaust conducting means to become larger. As a result, the undulated portions act as additional cooling ribs. The cooling effect thereby is particularly great if one part of the exhaust conducting means is configured to be the outer shell of the housing. Moreover, the undulated portions of the exhaust conducting means have a silencing effect without however substantially increasing the flow resistance.

In the embodiment described herein above, the undulated portions of the exhaust conducting means may be disposed so as to be parallel to each other. The size of the cross-sectional area through the exhaust conducting means does not vary along the longitudinal direction. If, by contrast, in another embodiment, the undulated portions of the exhaust conducting means exhibit a relative phase offset, the size of the cross-sectional area through the exhaust conducting means also varies along the longitudinal direction. The flow conditions of the exhaust can be readily influenced by a selective phase offset between the two undulated portions of the exhaust conducting means. The sound may for example be absorbed if the reflection behaviour of the acoustic waves of the exhaust can be varied by the phase offset. The acoustic waves may even be cancelled as a result thereof.

It is further envisaged, in another exemplary embodiment, that the conduct-type exhaust conducting means be configured as zigzags and that the key-shaped portions of the exhaust conducting means fixate an even or flat catalyst element. The key-shaped as well as the undulated portions can thereby be disposed both parallel and phase offset (laterally offset) relative to each other. The key-shaped portions are cheaper to manufacture than the undulated portions. It is understood that other portions of the exhaust conducting means that are implemented in another way and concurrently clamp an even or flat catalyst element may be envisaged.

In another exemplary embodiment of the exhaust system, the conduit-type exhaust conducting means is configured to be more or less linear or rectilinear and comprises a cross-sectional area that remains constant along the longitudinal direction. In this rectilinear exhaust conducting means, there is provided an undulated or a zigzag-shaped catalyst element that is clamped therein so as to be stationary. In this exemplary embodiment, the flow resistance is substantially dictated by the catalyst element. The surface however is smaller than with an exhaust conducting means having undulated or key-shaped portions. As a result, additional cooling ribs should be mounted to the even surface of the rectilinear exhaust conducting means in order to achieve a comparable cooling effect.

Figure 2:
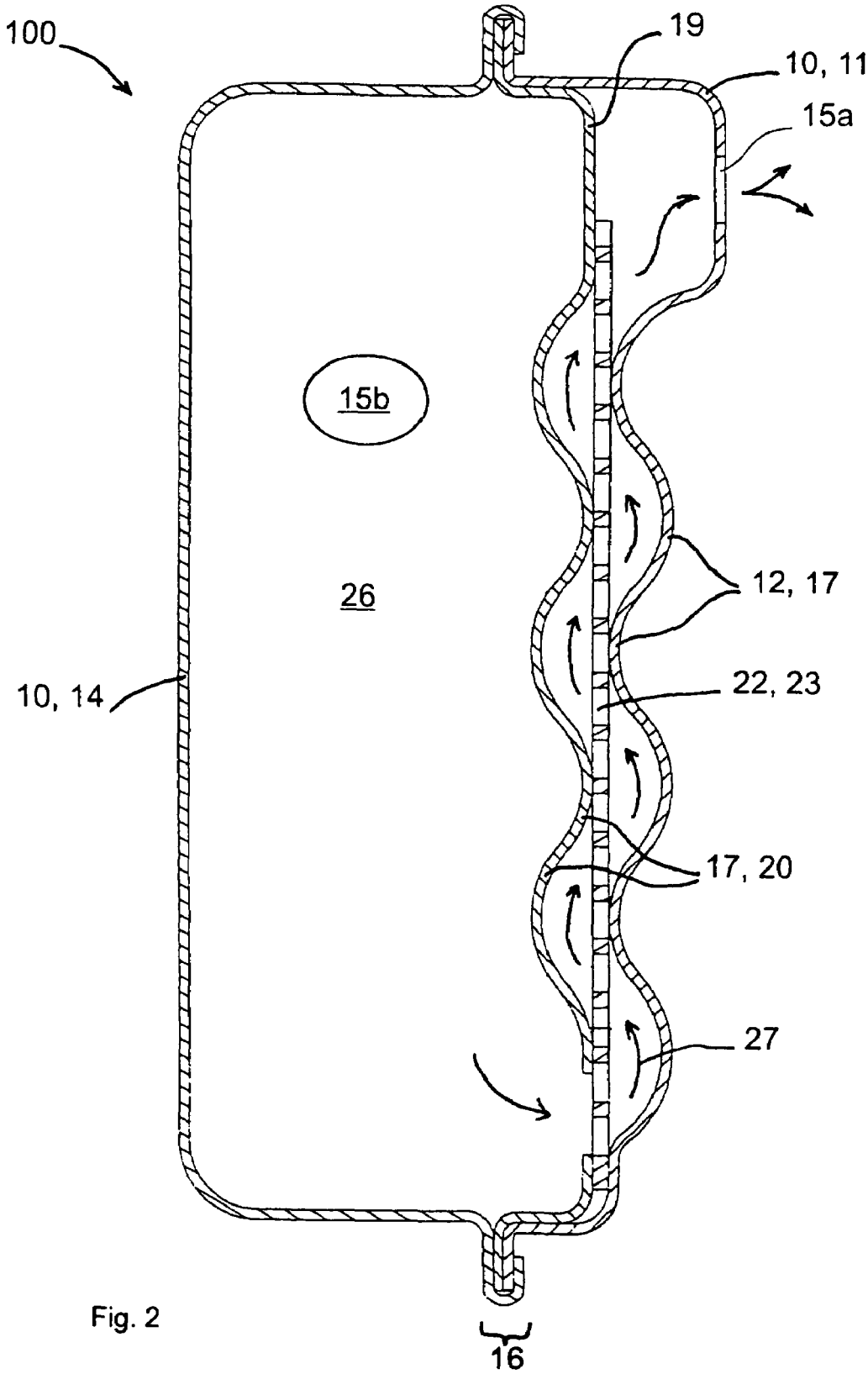
Figure 3A:
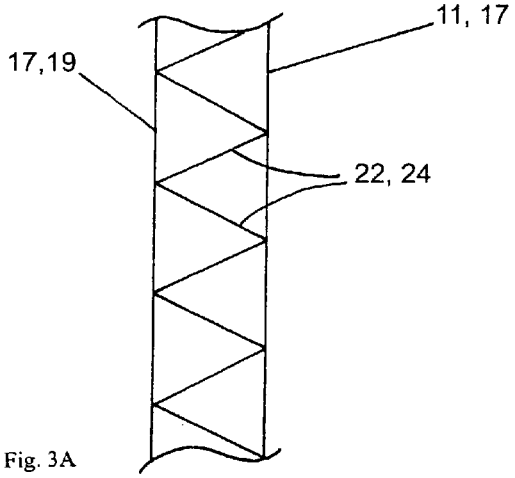
Figure 3B:
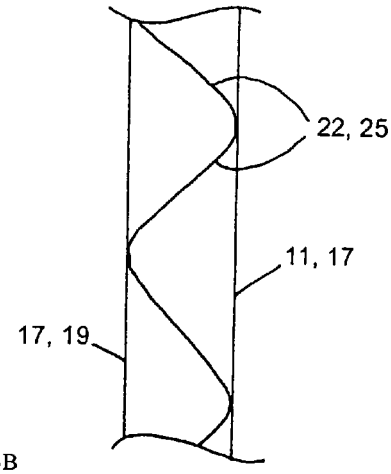
Figure 3C:
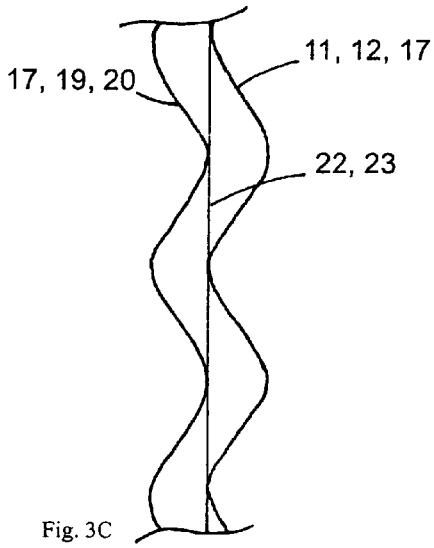
Figure 3D:
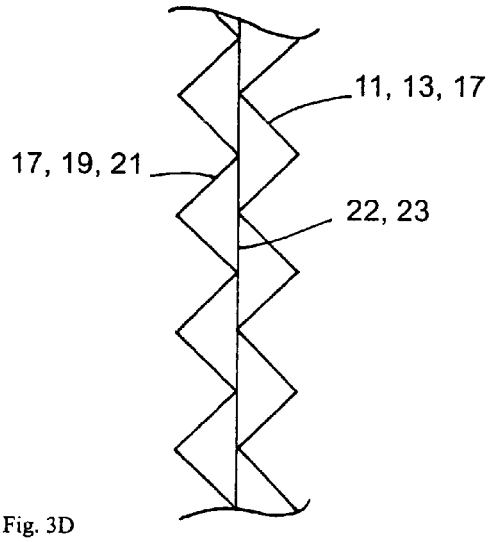
Figure 3E:
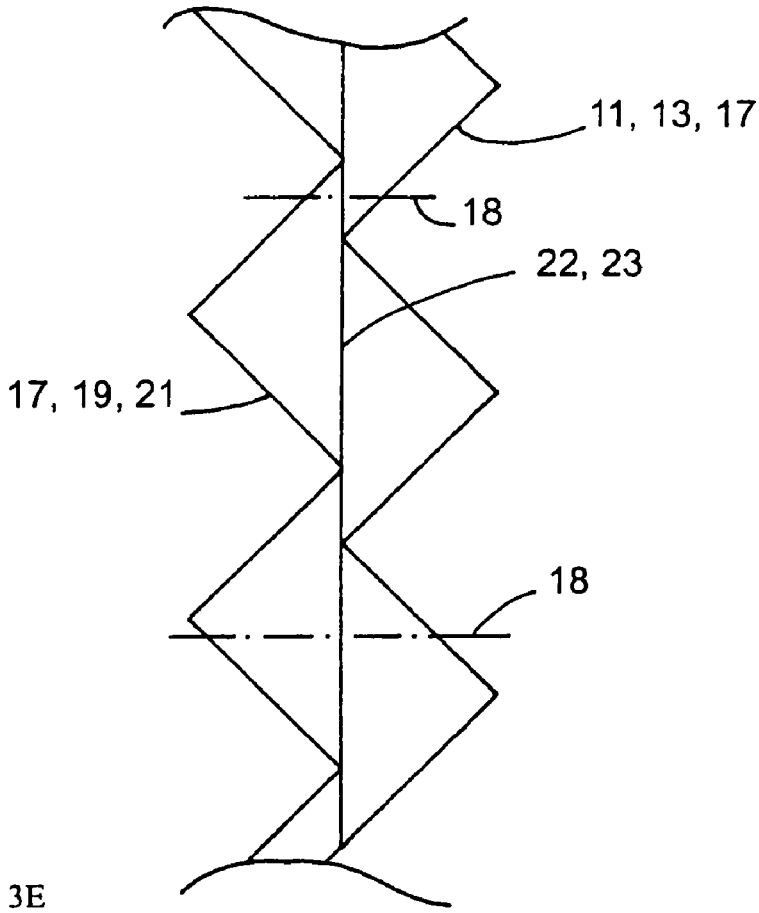
Figure 3F:
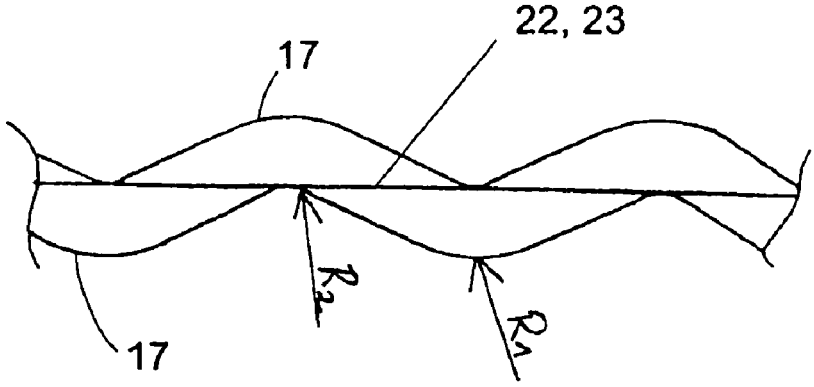
Figure 3G:
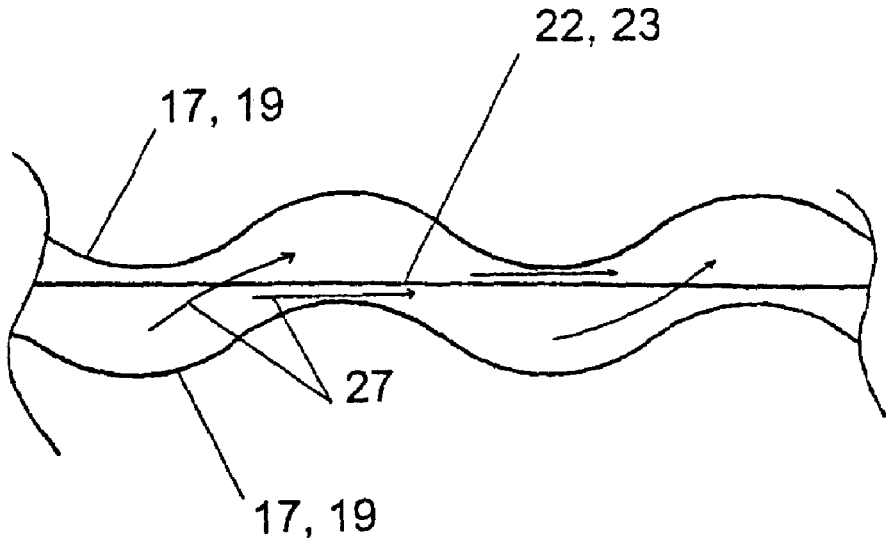
Figure 4:
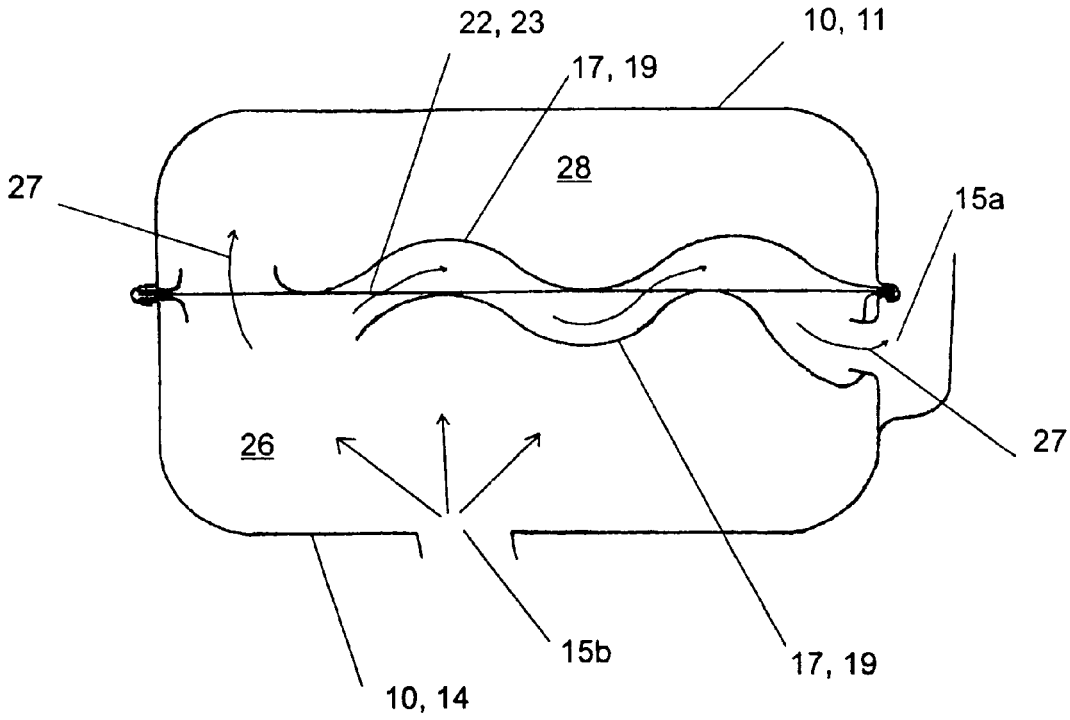

The invention will be explained in closer detail herein after with reference to the appended drawing illustrating various exemplary embodiments. In the schematic drawing:

FIG. 1 is a three-dimensional graphical representation of an exhaust system of the invention having an undulated exhaust conducting means and an even catalyst element, FIG. 2 is a longitudinal sectional view of the exhaust system of the invention as shown in FIG. 1, FIG. 3*a* is a schematic sectional illustration of a rectilinear, conduit-type exhaust conducting means having a zigzag-type catalyst element, FIG. 3*b* is a schematic sectional illustration of a rectilinear, conduit-type exhaust conducting means having an undulated catalyst element, FIG. 3*c* is a schematic sectional illustration of a meander-type exhaust conducting means having an even catalyst element, FIG. 3*d* is a schematic sectional illustration of a zigzag-type exhaust conducting means having an even catalyst element, with the cross section of the exhaust conducting means being constant, FIG. 3*e* is a schematic sectional illustration of a zigzag-type exhaust conducting means having an even catalyst element, with the cross section of the exhaust conducting means varying in the longitudinal direction, FIG. 3*f* is a schematic sectional illustration of a meander-type exhaust conducting means having undulations of various radii and an even catalyst element, FIG. 3*g* is a schematic sectional illustration of a meander-type exhaust conducting means like in FIG. 3*c* but with an even catalyst element that is retained by means of fastening means and FIG. 4 is a longitudinal section through another exhaust system of the invention with a meander-type exhaust conducting means, with an even catalyst element being stationarily disposed therein thanks to parts of the housing.

FIG. 1 shows a three-dimensional representation of a first embodiment of the exhaust system 100 of the invention. Said exhaust system 100 is configured to be substantially cuboid. Its housing 10 thereby consists of two elements, namely a front shell 11 and a rear shell 14. The two outer shells 11, 14 are solidly joined together by a beaded rim. It cannot be seen from FIG. 1 that a deflecting shell 19 is retained within the housing 10 by the bead 16. In the front shell 11 there are two exhaust discharge ports 15*a*. A portion of a mesh-type or of a perforated-plate-type catalyst element 22 disposed behind the front shell 11 can be seen through the right port 15*a*. As is evident, the front shell 11 comprises undulated portions 12 that concurrently form a portion of the exhaust conducting means 17. Through an exhaust inlet port 15*b*, the exhaust gases of the internal combustion engine enter the exhaust system 100.

The functioning principle of the exhaust system 100 becomes more apparent from FIG. 2. This Figure represents a longitudinal section of the exhaust system 100 of FIG. 1. Through an exhaust inlet port 15*b*, the exhaust gases enter a prechamber 26 of the exhaust system 100. In said prechamber 26, a first silencing can be performed by reflecting or absorbing the acoustic waves of the exhaust. For this purpose, the prechamber 26 may be filled with corresponding, sound absorbing materials or may contain corresponding structures which reflect acoustic waves. From said prechamber 26, the exhaust gases further pass through an opening in the deflecting shell 19 and through a first region of the even and mesh-type catalyst element 22, 23 into the meander-shaped exhaust conducting element 17. Said exhaust conducting element 17 is thereby formed into a conduit-type configuration and causes the exhaust stream to flow through the even catalyst element 22, 23 from alternate sides. In the present exemplary embodiment, the entire exhaust plume 27 (see arrow) is forced to pass seven times through the catalyst element 22 before it is allowed to escape from the exhaust system 100 through one of the exhaust discharge ports 15*a*. In the longitudinal section, the exhaust conducting means 17 appears to wind about the even catalyst element 22 like a meandering river. For this purpose, the exhaust conducting means 17 comprises undulated portions 12, 20 both in the front shell 11 and in the deflecting shell 19. In the longitudinal section, these portions 12, 20 also resemble a flat sine or cosine curve. The catalyst element 22 is held stationary by the deflecting shell 19 and the front shell 11. To put it more precisely, the even catalyst element 22 is clamped on the one side by the peaks (crests) of the undulated portions 20 of the deflecting shell 19 and on the other side by the depressions (troughs) of the undulated portions 12 of the front shell 11. In order for the required (clamping) force to be capable of actually acting onto the catalyst element 22 through the two parts 11 and 19 of the exhaust conducting means 17, said catalyst element must be configured to be self-supporting.

In the concrete example of FIG. 2, the undulated portions 12, 20 of the exhaust conducting means 17 are arranged parallel to each other and comprise substantially the same radius. As a result, any cross-sectional area of the undulated portions 12, 20, which is normal to the edge of cut of the catalyst element 22, always has the same size so that in this region the exhaust gases are neither caused to compress nor do they expand by themselves. Since the inner surfaces of the exhaust conducting means 17 have no sharp-edged projections, the flow resistance for the exhaust is accordingly low.

In the exemplary embodiment of FIG. 2, the deflecting shell 19 is configured to be a separate part of the exhaust conducting means 17 or of the exhaust system 100 respectively. In order to secure the deflecting shell 19 in the housing 10, it is frictionally retained at its rim by the front shell 11 and the rear shell 14. For this purpose, the rim of the rear shell 14 is beaded about the rim of the deflecting shell 19 and of the front shell 11. Likewise, the rim of the front shell 11 could also be used for the bead 16. In order to allow for low cost manufacturing of the outer shells 11, 14, said shells can be made of simple deep draw parts. Plain (galvanized) sheet metal can be used as the manufacturing material. Likewise, special steel can be used as the manufacturing material, preferably for the front shell 11.

In a similar exemplary embodiment of the exhaust system 100 of the invention that has not been illustrated herein, it is envisaged that even the deflecting shell 19 be formed integral with the rear shell 14 or the front shell 11. As a result, the entire housing 10 and the additional exhaust conducting means 17 would be made from two parts.

The FIGS. 3*a* through 3*g* illustrate a schematic sectional view of various embodiments of the exhaust conducting means 17 having a catalyst element 22 configured accordingly. In these exhaust conducting means 17, the additional regions that serve for fastening are not illustrated. FIG. 3*a* shows a rectilinear exhaust conducting means 17 that can consist of a deflecting shell 19 and of a front shell 11 and in which a catalyst element 22 has the shape of a zigzag curve 24. Said catalyst element 22 is clamped in the exhaust conducting means 17 by the peaks of its own zigzag shape 24.

In the FIG. 3*b*, the same rectilinear exhaust conducting means 17 is utilized as in FIG. 3*a*. Only that here, the catalyst element 22 does not have the shape of a zigzag curve 24 but of an undulated curve 25. In this exemplary embodiment as well, the catalyst element 22 is held by the crests and troughs of the undulated curve 25.

The last two examples mentioned have the advantage that the exhaust conducting means 17 offers a particularly low flow resistance and that it is easy to manufacture.

FIG. 3*c* illustrates a meander-type exhaust conducting means 17 comprising undulated portions 12, 20. Within the meander-type exhaust conducting means 17, there is disposed an even or flat catalyst element 22. This embodiment substantially corresponds to the example of the exhaust conducting means 17 of FIG. 1 and 2.

By contrast, FIG. 3*d* shows a zigzag-type exhaust conducting means 17 that comprises key-shaped portions 13, 21. For the rest, the same catalyst element 22 as in FIG. 3*c* can also be utilized. Also, the key-shaped portions 13, 21 are arranged parallel to each other like in the example shown in FIG. 3*c*, so that any cross sectional area, which is normal to the edge of cut of the catalyst element 22, has a constant size. Unfortunately, the edges inside the exhaust conducting means 17 result in an increase in exhaust flow resistance. But the key-shaped portions 13, 21 provide for a good silencing effect and provide an enlarged surface for cooling the exhaust gases.

FIG. 3*e* also illustrates a zigzag-type exhaust conducting means 17 with key-shaped portions 13, 21. The key-shaped portions 13, 21 however exhibit a phase offset in the longitudinal section, i.e., they are laterally offset relative to each other. As is evident from the cross sections 18 shown, the cross sectional area of the exhaust conducting means 17 varies along the longitudinal axis (parallel to the edge of cut of the catalyst element 22). This measure permits to achieve a particular silencing effect.

FIG. 3*f* further shows a sectional view of an exhaust conducting means 17 that consists of an undulated profile and is formed into a meander-type configuration. In this exemplary embodiment as well, a flat catalyst element 22 is held stationary by the exhaust conducting means 17 inside thereof. However, the peaks and depressions of the undulation-type exhaust conducting means 17 have different radii R1 and R2. The undulated curve may for example be formed by the two radii R1 and R2 that are joined together by their corresponding tangents. This measure permits to positively influence the flow properties of the exhaust conducting means 17. Moreover, the contact surface between the catalyst element 22 and the exhaust conducting means 17 may thus be minimized so that, as far as practicable, the entire surface of the catalyst element 22 is available for the exhaust gases to flow through. Or, to put it another way, the catalyst surface is more readily accessible for the exhaust gases. For this purpose, the smaller one of the two radii (here radius R2) is directed in the direction of the catalyst element 22. The larger radius (here radius R1), by contrast, is disposed on the sides of the exhaust conducting means 17 that are turned away from the catalyst element 22.

A particular arrangement of the catalyst element 22 in the exhaust conducting means 17 is shown in FIG. 3*g* (also see claim 8). In this variant, the flat catalyst element 22 is not retained by the undulated profile of the exhaust conducting means 17 but by additional fastening means that are not shown herein. In this concrete example, the catalyst element 22 has no contact whatsoever with the exhaust conducting means 17. This embodiment is however not limited thereto so that there may well be an at least sporadic contact between the two parts. The catalyst element 22 can e.g. be fastened by the housing shells 11, 14 being beaded 16 together. As already mentioned, bypasses for the exhaust plume are thus cleared, said bypasses permitting to adjust the conversion rate and to achieve higher production tolerances of the exhaust system 100. This measure also permits to minimize the flow resistance of the exhaust conducting means 17 since a certain part of the exhaust is intentionally led through the bypasses past the catalyst element 22. The path of the exhaust plume through the bypasses is shown by arrows 27 oriented parallel to the catalyst element 22. Additionally, heat-dependent changes of the shape of the exhaust conducting means 17, of the catalyst element 22 or of the housing 10, which are occasioned by permanent variations in temperatures, may be eliminated.

FIG. 4 discloses an exhaust system 100 that is formed from 4 shells, namely the front and rear shells 11, 14 and two deflecting shells 19, forming the exhaust conducting means 17. The two deflecting shells 19 are positioned between the two outer shells 11, 14. The catalyst element 22 as well can be held within the exhaust conducting means 17 by the two outer shells 11, 14. For this purpose, the inner parts 19, 22 are clamped by means of the bead 16. Further, by positioning the exhaust conducting means 17 in the center of the exhaust system 100, a second upper chamber is formed (next to the prechamber 26), which can serve as an additional silencing volume or chamber 28. Said additional chamber 28 may accordingly contain means for further silencing by reflection or absorption. Moreover, by disposing the exhaust conducting means 17 in the center, a "cold" front shell 11 is made possible. This permits to considerably reduce the risk for a user of the corresponding machine to which the exhaust system 100 is mounted of being burned when inadvertently touching the same. A rectilinear or zigzag-type exhaust conducting means 17 could be used rather than the illustrated meander-type exhaust conducting means 17. It is also envisaged to position the catalyst element 22 in the exhaust system 100 where it is not held stationary by means of the exhaust conducting means 17 but and/or by means of additional fastening means. The afore mentioned bypasses may thereby also be provided in the exhaust conducting means 17.

It should be noted that the exhaust system 100 of the invention can be used both as a complete exhaust system and as a complementary initial, central or end system for a partially existing exhaust system. Likewise, two or more flat or even catalyst elements 22 may be used concurrently. Further, two or more exhaust conducting means 17, which are for example disposed so as to be parallel to each other, can be additionally provided in an exhaust system 100. Also, the most varied combinations of the exemplary embodiments are possible, provided they are not mutually exclusive from a technical point of view.

To conclude, it should be noted that the exhaust system 100 of the invention may also comprise other technical features than the ones described herein as long as they have the same function.

LIST OF NUMERALS

100 exhaust system
10 housing
11 front shell
12 undulated portions of 11
13 key-shaped portions of 11
14 rear shell
15*a* exhaust discharge port
15*b* exhaust inlet port
16 joint (bead)
17 exhaust conducting means
18 outlined cross-section through 17
19 deflecting shell
20 undulated portions of 19
21 key-shaped portions of 19
22 catalyst element
23 even curve of 22
24 zigzag curve of 22
25 undulated curve of 22
26 prechamber
27 arrow for exhaust plume
28 additional chamber

What is claimed is:

1. An exhaust system for an internal combustion engine, said exhaust system having a housing in which there are provided an exhaust inlet port and another exhaust discharge port, and a catalyst element that is disposed within the housing of the exhaust system for purifying the exhaust of the internal combustion engine in such a manner that a substantial part of the exhaust at least is caused to flow through the catalyst element, characterized in that:

the exhaust gases alternately flow through the catalyst element through an exhaust conducting means;

the exhaust conducting means is of a conduit configuration and that the catalyst element is disposed inside a conduit portion where it is held stationary by the exhaust conducting means;

the exhaust conducting means is made from at least two parts;

an outer shell of the housing forms a part of the exhaust conducting means;

a part of the exhaust conducting means is formed by a deflecting shell, said deflecting shell being retained by the outer shells of the housing;

the deflecting shell of the exhaust conducting means and one outer shell of the housing are made from one piece; and the outer shells of the housing and the deflecting shell of the exhaust conducting means are solidly joined together by a bead.

2. The exhaust system as set forth in claim 1, characterized in that the catalyst element is configured to be even, or largely even, and planar and that portions of the catalyst element are configured so that the exhaust is allowed to alternately flow through one of said portions after the other so that the exhaust gases alternately flow several times through the catalyst element through the exhaust conducting means.

3. The exhaust system as set forth in claim 1, characterized in that the catalyst element is built to be self-supporting.

4. The exhaust system as set forth in claim 1, characterized in that the catalyst element is of a mesh configuration.

5. The exhaust system as set forth in claim 1, characterized in that the catalyst element is of a perforated plate configuration.

6. The exhaust system as set forth in claim 1, characterized in that the catalyst element contains a coated metal mesh.

7. The exhaust system as set forth in claim 1, characterized in that the catalyst element contains a coated perforated metal plate.

8. The exhaust system as set forth in claim 1, characterized in that the catalyst element is disposed in the exhaust conducting means where it is held stationary by fastening means, said fastening means lying inside and/or outside the exhaust conducting means.

9. The exhaust system as set forth in claim 1, characterized in that the exhaust conducting means is of a meander configuration and that undulated portions of the exhaust conducting means stationarily hold the even catalyst element by clamping.

10. The exhaust system as set forth in claim 9, characterized in that the undulated portions of the exhaust conducting means are parallel to each other so that the cross-sectional area of the exhaust conducting means is substantially constant.

11. The exhaust system as set forth in claim 10, characterized in that the undulated portions of the exhaust conducting means are phase offset so that the size of the cross-sectional area of the exhaust conducting means also varies in the longitudinal direction.

12. The exhaust system as set forth in claim 1, characterized in that the exhaust conducting means is of a zigzag configuration and that key-shaped portions of the exhaust conducting means stationarily hold an even catalyst element by clamping.

13. The exhaust system as set forth in claim 1, characterized in that the exhaust conducting means is configured to be rectilinear with a constant cross section and stationarily holds an undulated or zigzag catalyst element by clamping.

* * * * *

UNITED STATES PATENT AND TRADEMARK OFFICE

CERTIFICATE OF CORRECTION

PATENT NO. : 7,399,452 B2
APPLICATION NO. : 11/155188
DATED : July 15, 2008
INVENTOR(S) : Harry Radel and Markus Krueger It is certified that error appears in the above-identified patent and that said Letters Patent is hereby corrected as shown below:

On the Title page of the patent, in column 1, under Item [30] "Foreign Application Priority Data," replace:

"Jun. 17, 2004 (DE) ... 20 2004 009 506 U
Dec. 20, 2004 (DE) ... 20 2004 019 896 U"

with:

--May 13, 2005 (DE) ... 20 2005 007 861.1
Jun. 17, 2004 (DE) ... 20 2004 009 507.6--

Signed and Sealed this

Fourth Day of November, 2008

JON W. DUDAS
*Director of the United States Patent and Trademark Office*